United States Patent [19]

Söderberg et al.

[11] Patent Number: 4,928,945

[45] Date of Patent: May 29, 1990

[54] SHEET COLLATING MACHINE WITH AUTOMATIC DOUBLE FEED PREVENTION

[75] Inventors: Terje Söderberg, Lidingo; Rolf Södersteen, Enskede; Ulrik Töreman, Bandhagen, all of Sweden

[73] Assignee: Plockmatic International AB, Stockholm, Sweden

[21] Appl. No.: 323,704

[22] Filed: Mar. 15, 1989

[30] Foreign Application Priority Data

Mar. 15, 1988 [SE] Sweden ..... 8800939

[51] Int. Cl.[5] ..... B65H 7/18; B65H 3/06; B65H 1/04

[52] U.S. Cl. ..... 271/9; 271/117; 271/259; 271/265

[58] Field of Search ..... 271/9, 10, 114, 116, 271/117, 118, 256, 257, 258, 259, 262, 263, 264, 265, 266, 110, 111; 270/58

[56] References Cited

U.S. PATENT DOCUMENTS

| | | | |
|---|---|---|---|
| 3,584,865 | 6/1971 | Mignano | 270/58 X |
| 3,645,615 | 2/1972 | Spear, Jr. . | |
| 3,773,313 | 11/1973 | Bassett . | |
| 3,887,176 | 6/1975 | Paulus et al. | 270/58 |
| 3,947,015 | 3/1976 | Funk et al. | 271/9 |
| 3,981,497 | 9/1976 | Feinstein, Jr. et al. . | |
| 4,053,149 | 10/1977 | Paulus | 270/58 |
| 4,244,564 | 1/1981 | Brown | 270/58 X |
| 4,323,229 | 4/1982 | Meus | 270/58 |
| 4,471,954 | 9/1984 | Bourg . | |
| 4,616,816 | 10/1986 | Stauber | 271/9 X |

*Primary Examiner*—H. Grant Skaggs
*Assistant Examiner*—Edward S. Ammeen
*Attorney, Agent, or Firm*—Sughrue, Mion, Zinn, Macpeak and Seas

[57] ABSTRACT

A sheet collating machine includes feed-up devices (7) disposed at bins (1) and having driven feed-up wheels (8), the feed-up devices being pivotal between a lowered position in which the feed-up wheels engage stacks (2) of paper sheets and a raised position in which the wheels are disengaged from the stacks. A conveying path (3) is defined by a plurality of conveyor and press rollers (4), along the upper side of which a corresponding number of backing rollers (6) are disposed, and a conveyor belt (5) runs between the rollers. A sensor (12) is actuated by a spring member (11) which extends crosswise over the conveyor path when no sheet protrudes between the press roller and the belt, and the spring member is lifted from its contact with the sensor when a sheet passes the latter. When no sheet is advanced within a predetermined period the sensor furnishes a signal to a control device which automatically causes a drive device to lift the feed-up device to its raised position.

7 Claims, 1 Drawing Sheet

SHEET COLLATING MACHINE WITH AUTOMATIC DOUBLE FEED PREVENTION

BACKGROUND OF THE INVENTION (1) Field of the Invention

This invention concerns a device for feeding up sheets in a sheet collating machine, wherein preferably sheets of paper in the form of stacks are positioned in bins which are located in the longitudinal direction of the machine below a conveying path which is equipped with conveying members, with a feed-up device being provided for each bin and comprising one or more feed-up wheels which are connected to a driving means, each feed-up device being pivotal between a lowered position, in which the feed-up wheels engage the stack of sheets and feed up one sheet at a time towards the conveying path, and a raised position in which the feed-up wheels are disengaged from the stack.

(2) Description of the Prior Art

A collating machine for sheets, primarily paper sheets, comprises a plurality of bins for stacks of sheets, said stacks containing sheets of the same or different types. In collating sheets from individual stacks to form a sheet set one sheet at a time is fed from the respective stack for collecting on a conveying path. In feeding up the sheets from the respective stacks an indication is given if any sheet at all is fed up onto the conveying means. If a sheet is not fed up onto the conveying path from one of the stacks, the machine will deliver a signal which indicates that the set of sheets is incomplete and the machine will stop.

In the known machines a feed-up device is disposed in conjunction with each bin and exhibits feed-up wheels which are positioned such, that they engage the upper sheet in a stack of sheets that is located in the bin. When the feed-up wheels are rotated the upper sheet of the stack is fed upwards between a press roller and a belt running above this roller. The sheets which have been fed upwardly are gripped there by the belt and the rotating press roller and are fed along the conveying path. The feed-up devices at the respective bins can be raised mechanically by a lifting device which is common to all of the feed-up devices. Also, each feed-up device can be lifted manually with a specific means, which can occur with respect to the bins in which no stacks are disposed during a collating procedure. In the known machine the feed wheels in the feed-up devices are driven by one and the same drive motor.

In the sheet collating machine known up to now there is a danger of so-called additive overfeeding of sheets from one and the same bin, which occurs by the feed-up device withdrawing sheets from the stack in the bin even after the first sheet has been delivered from the feed-up device. The explanation of this is that the machines of the prior art do not exhibit control means which influence the feed-up device when a sheet begins to protrude between the press roller and the belt lying thereabove in the conveying path.

SUMMARY OF THE INVENTION

The purpose of the present invention is to provide a device for feeding up sheets in a sheet collating machine, which device provides more reliable collating of sheets than can be achieved in known sheet collating machines. The sheets in the collating machine are disposed in stacks in bins which are located in the longitudinal direction of the machine below a conveying path which is provided with conveying members, and a feed-up device is disposed at each bin and comprises one or more feed-up wheels which are connected to drive means. Each feed-up device is pivotal between a lowered position, in which the feed-up wheels engage the stack of sheets and feed up one sheet at a time towards the conveying path, and a raised position in which the feed-up wheels disengage the stack.

According to a characteristic feature of the invention the feed-up device of each bin is connected to drive means disposed at the respective bins and comprises a lifting device which is connected on one hand to the drive means and on the other hand to a control device with the assistance of which the drive means can be made to lift the feed-up device to its raised position together with the lifting device.

The control device is connected to a sensor at the relevant bin, said sensor delivering a signal to the control device when no sheet is fed forward within a predetermined time so as to automatically cause the drive device to raise the feed-up device to its raised position together with the lifting device. The feed-up device is preferably also connected to a weighting device, with the assistance of which it is possible to lift the feed-up device to its raised position manually.

In a preferred embodiment of the invention the conveying path comprises a plurality of conveying and press rollers disposed behind each other, along the upper sides of which a corresponding number of backing rollers are positioned, between which rollers a conveying belt preferably runs, with a press roller being positioned at each bin. The above-mentioned sensors are disposed behind each respective press roller in the conveying direction of the path, and with their help an indication is given that a sheet has been fed upwards from the bin to the extent that its leading edge protrudes between the relevant press roller and the belt so as to discontinue the driving of the feed-up wheels. Said sensor can be comprised of a microswitch which is retained actuated by a spring member which extends crosswise over the conveying path when no sheet protrudes between the press roller and the belt and which is lifted from the contact of the sensor when a sheet passes the latter. The drive means primarily consists of a reversible electric motor which is connected to the feed-up wheels through a drive shaft and a power transmission, with a member included in the power transmission being connected to the drive shaft via a first free wheeling hub. The lifting device is connected to the drive shaft of the drive means via a second free wheeling hub which runs freely when the first free wheeling hub engages the drive shaft.

The power transmission between the drive shaft and the feed wheels is disposed on a linkage arm which is pivotally suspended on the drive shaft and consists primarily of a belt transmission comprising a first gear belt wheel which on the one hand is connected to the drive shaft via the first free wheeling hub and on the other hand is connected to a second gear belt wheel by means of a gear belt. The second gear belt wheel is securely attached to a feed shaft which carries the feed wheels. The lifting device can to advantage comprise a pivotally suspended lifting linkage which on the one hand is connected to the drive shaft via the second free wheeling hub and on the other hand is connected to the linkage arm which carries the power transmission.

The mentioned weighting device, with the assistance of which the respective feed-up means can be lifted manually to its raised position, includes a crank whose axis of rotation is aligned with the drive shaft and whose throw is connected on the one hand to the linkage arm with the power transmission and on the other hand to the lift linkage for the automatic lifting.

BRIEF DESCRIPTION OF THE DRAWING

The invention will be described specifically below in the form of an embodiment with reference to the accompanying drawing.

DETAILED DESCRIPTION OF THE PREFERRED EMBODIMENT

Figure 1:
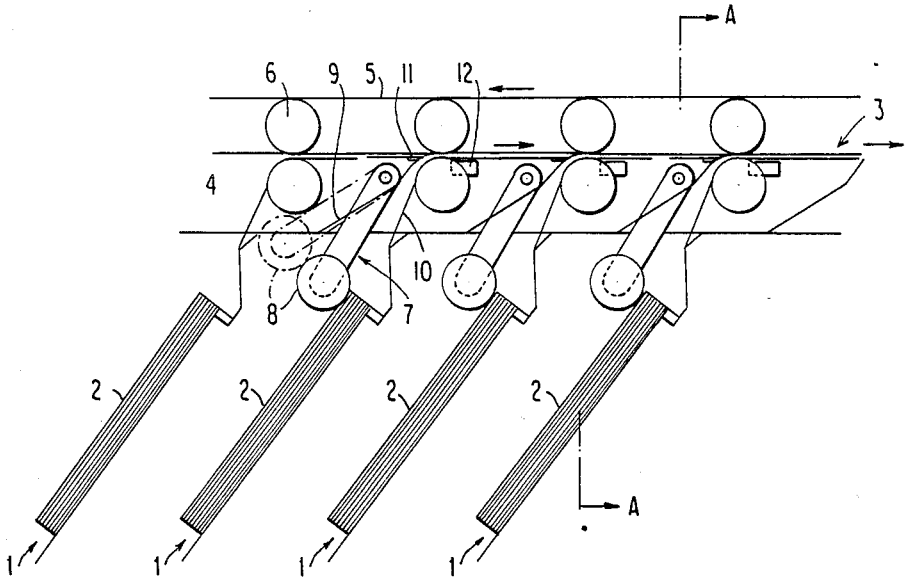
FIG. 1 shows a diagrammatical lateral view of a portion of a sheet collating machine provided with a feed-up device in accordance with invention and FIG. 2 shows a feed-up device in accordance with FIG. 1 partly in cross section along the line A—A in FIG. 1 at right angles to the direction of conveyance of the sheet collating machine.

A collating machine for example for paper sheets in accordance with FIG. 1 comprises a plurality of bins 1 for stacks 2 of paper sheets, each stack 2 containing sheets of the same type or of different types. In collating paper sheets from the respective stacks 2 to a set of sheets, one sheet is fed upwards at a time from each stack 2, with the respective sheets being collected on a conveying path 3 which is formed of a number of conveying and press rollers 4 disposed behind each other, which latter comprise the conveying path for sheets which have been fed upwards from the bin 1 which are located at the lower side of the path, wherein the sheets are conveyed somewhat overlapping each other on the conveying path. The press rollers 4 urge the overlapping set of sheets upwardly towards a conveying belt 5 which runs along the conveying path with the press rollers 4, said conveying belt 5 being supported by backing rollers 6 which are disposed above the respective press rollers 4.

Figure 2:
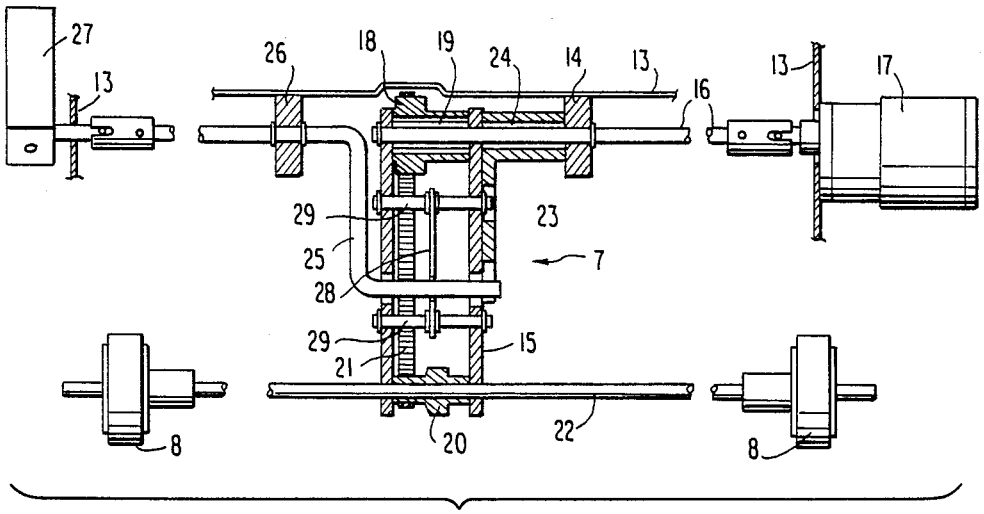

A feed-up device 7 is positioned at each bin 1 and exhibits two feed-up wheels 8 located on a column shaft as shown in FIG. 2, said wheels being disposed such as to engage the upper sheet in the stack 2 of sheets which is positioned in the bin 1. The feed-up wheels 8 engage the upper portion of the sheet in the stack which slants somewhat forwardly in the conveying direction. When the feed-up wheels 8 are caused to rotate counterclockwise in FIG. 1 the upper sheet in the stack is fed upwardly between an upper guide plate 9 and a lower guide plate 10 to a point where the press roller 4 which is located most closely contacts the conveying belt 5 which is disposed thereabove. The upwardly fed sheet is gripped there by the running conveying belt 5 and the rotating press roller 4 and is fed on along the conveying path 3. A spring member 11 extends from the inlet side with the guide plates 9, 10 between the press roller 4 and the conveying belt 5 and out from the press roller 4 where it contacts a microswitch 12. Guide plate 9 guides the upwardly fed sheet to secure engagement between the press roller 4 and the conveying belt 5. When the upwardly fed sheet passes between the press roller 4 and the conveyor belt 5 the sheet lifts the spring element 11 from the contact with the microswitch 12 which in turn affects the feeding device 7 in such manner that the feed-up wheels 8 cease to rotate and feed the sheet upwardly. However, the feed-up wheels 8 still engage the sheet and are made to roll freely thereagainst with the help of a first free wheeling hub which will be described below.

The feed-up device 7 which is illustrated in FIG. 2 is suspended in a first bracket 14 in the frame of the sheet collating machine. The feed-up device 7 comprises a linkage arm 15 which is pivotally suspended on a drive shaft 16 which in turn is suspended in the first bracket 14. The drive shaft 16 is interconnected to an electric direct current motor 17 which is positioned on the frame 13 of the machine, and the drive shaft 16 has two suspending points in the frame 13. An upper gear belt wheel 18 is connected to drive shaft 16 over a first free wheeling hub 19, which has been mentioned above, whereby the upper gear belt wheel 18 only can be driven positively by the drive motor 17 in one direction. The upper gear belt wheel 18 is connected to a lower gear belt wheel 20 by means of a gear belt 21. The lower gear belt 20 is securely fastened to a feeding shaft 22 which in turn carries feed-up wheels 8 securely attached one to each end of shaft 22, said two feed-up wheels 8 engaging the upper sheet in a stack 2 of sheets. The respective feed-up wheels 8 are provided with a web of rubber with good gripping action. In feeding up the sheet from the stack 2 the motor 17 causes the drive shaft 16 to rotate in a direction that locks the first free wheeling hub 19 and transfers the rotation of the driving shaft 16 to the upper gear belt wheel 18, via the gear belt 21 and the lower gear belt wheel 20 to the drive shaft 22 and the feed-up wheels 8.

A lifting linkage 23 is also disposed on the drive shaft 16 via a second free wheeling hub 24 which is free running when the drive shaft 16 rotates in a direction in which the first free wheeling hub 19 is locked and transfers the rotation to the upper gear belt wheel 18. The second free wheeling hub 24 is instead locked when the direction of rotation of the motor 17 is reversed, and the lifting linkage 23 is provided with a rotational movement which in turn lifts the feed-up device 7 from engagement with the stack 2 of sheets to a position which is illustrated with dashed lines in FIG. 1 for the second feed-up device 7 in order from the left in the figure. In this position the bin 1 can be replenished with a new stack 2 of sheets, for example by bin 1 being drawn out towards one or the other side of the machine. The lifting linkage 23 is connected to a crank 25 which is mounted on the one hand in a second bracket 26 on the frame 13 of the machine and on the other hand at one side of the frame where the crank 25 carries an adjustable weight 27. The opposite end of the crank 25 extends into apertures in the linkage arm 15 and is connected to the lifting linkage 23 and to a lifting disc 28 which extends in the longitudinal direction of the linkage arm 15 and is connected to the latter by means of two pins 29. The feed-up device 7 can thus also be raised manually by means of the weight 27 and the crank 25.

By means of the weighting device 27, 25 it is possible to adjust the pressure of the feed-up wheels 8 against the uppermost paper in the stack of paper so as to achieve an adaptation to the relevant thickness and type of paper for providing greater reliability in collating, for example to avoid duplication of papers.

The feed-up devices 7 utilized in the machine are controlled by a control device which is not illustrated in the figures and which is controlled by an operator by means of a keyset on a front panel. Alternatively controlling can occur by programming. If so either the feed-up wheels 8 will be made to engage the uppermost paper in each stack of papers so that the motor 17 drives up the paper from the stack or otherwise a signal will be delivered, which in turn causes the motors 17 at the respective bins 1 to be driven in the opposite direction to the feeding direction, whereby the lifting linkage 23 sets the feed-up device 7 to its raised position.

We claim:

1. A device for collating sheets in an elongated sheet collating machine, comprising:

a conveying path (3), a conveying belt (5), and conveying members, said conveying members comprising a plurality of conveying and press rollers (4) along one side of which a corresponding plurality of backing rollers (6) are disposed, said conveying members being disposed along said conveying path, a plurality of bins (1), said bins being located in a longitudinal direction of the machine below said conveying path and being disposed for holding sheets of paper in the form of stacks (2), said conveyor belt running between said conveying and press rollers and said backing rollers, with one of said conveying and press rollers being disposed after each individual bin, a plurality of feed-up devices (7), a plurality of feed-up wheels (8), and a plurality of drive means (16–22) individually connected to said feed-up wheels, said feed-up devices each comprising a lifting device (23) and at least one of said feed-up wheels, and being individually disposed at an associated one of said bins, each feed-up device being pivotal between a lowered position, in which said at least one feed-up wheel engages a respective stack of sheets for feeding up one sheet at a time towards said conveying path, and a raised position, in which said at least one feed-up wheel is disengaged from said stack, and being at said associated bin connected to an associated one of said drive means disposed at said associated bin, a control device, each of said lifting devices being individually connected (24) to an associated one of said drive means and to said control device for individually causing said associated drive means together with said lifting device to lift the associated feed-up device to a raised position, a plurality of sensors in the form of microswitches (12), said control device being connected to said sensors, and a plurality of spring members (11), said spring members extending across said conveying path, said microswitches being individually maintained actuated by an associated one of said spring members when no sheet protrudes between a respective press roller and said conveyor belt, each spring member being moved from contact with the associated sensor when a sheet passes the latter, and each of said sensors delivering, when a sheet is not advanced within a predetermined period, a signal to said control device for automatically causing said associated drive means to lift the associated lifting device and feed-up device to said raised position, and wherein each of said drive means comprises a reversible electric motor (17), which is connected to at least one of said feed-up wheels over a drive shaft (16) and a power transmission, with a member (18) in the power transmission being connected to said drive shaft via a first free wheeling hub (19).

2. A device in accordance with claim 1, wherein each feed-up device is connected to a weighting member (27) for influencing the pressure of the at least one associated feed-up wheel against an uppermost paper in a stack.

3. A device in accordance with claim 1 or 2, wherein each of said sensors are disposed after an associated one of said press rollers in the conveying direction of the path to sense a sheet being feed up from the associated bin when a leading edge thereof extends between said press roller and the belt, and to stop the driving of the at least one associated feed-up wheel.

4. A device in accordance with claim 1, wherein each lifting device is connected to the associated drive shaft of the associated drive means via a second free wheeling hub (24) which is free running when the associated first free wheeling hub is in engagement with said drive shaft.

5. A device in accordance with claim 4, wherein each power transmission is disposed on a linkage arm (15) which is pivotally suspended on the associated drive shaft and comprises a belt transmission with a first gear belt wheel (18) which is connected to said drive shaft via the associated first free wheeling hub and also is connected to a second gear belt wheel (20) via a gear belt (21), said second gear belt wheel being secured to a feed shaft (22) carrying the at least one associated feed-up wheel.

6. A device in accordance with claim 5, wherein each lifting device comprises a lifting linkage (23) which is connected to the associated drive shaft via a second free wheeling hub and also is connected to the associated linkage arm.

7. A device in accordance with claim 6, wherein each feed-up device is connected to a weighting member comprising a crank (25) having an axis of rotation aligned with the associated drive shaft and a throw connected to the associated linkage arm and lifting linkage.

* * * * *